US008257204B1

(12) United States Patent
Liu et al.

(10) Patent No.: US 8,257,204 B1
(45) Date of Patent: Sep. 4, 2012

(54) AUTOMATIC BALL COLLECTION SYSTEM FOR TABLE TENNIS

(75) Inventors: Shu-Hua Liu, New Taipei (TW); Po-Heng Liu, New Taipei (TW)

(73) Assignee: Shu-Hua Liu, New Taipei (TW)

( * ) Notice: Subject to any disclaimer, the term of this patent is extended or adjusted under 35 U.S.C. 154(b) by 0 days.

(21) Appl. No.: 13/114,051

(22) Filed: May 24, 2011

(51) Int. Cl.
*A63B 47/00* (2006.01)

(52) U.S. Cl. ..... 473/460; 473/431; 473/475

(58) Field of Classification Search ..... 473/431, 473/459, 460, 475
See application file for complete search history.

(56) References Cited

U.S. PATENT DOCUMENTS

| | | | | |
|---|---|---|---|---|
| 4,004,806 | A * | 1/1977 | Malik | 473/474 |
| 4,875,678 | A * | 10/1989 | Sawyer | 473/475 |
| 6,220,452 | B1 * | 4/2001 | Yamashita et al. | 209/675 |
| 2006/0229146 | A1 * | 10/2006 | Giegerich | 473/431 |
| 2009/0163302 | A1 * | 6/2009 | Daniell | 473/435 |

* cited by examiner

*Primary Examiner* — Raleigh W. Chiu
(74) *Attorney, Agent, or Firm* — Leong C. Lei

(57) ABSTRACT

The automatic ball collection system contains a blower sub-system and a collection device. The blower sub-system drives the balls on the ground towards the collection device, and the balls are then automatically collected by the collection device. The blower sub-system contains a number of blowing devices configured at the corners capable of producing air flow substantially along ground surface so as to push the balls to roll towards the collection device. As such, the players' time and effort in constant bending and picking up balls, and the possible injury resulted as such are avoided.

10 Claims, 11 Drawing Sheets

AUTOMATIC BALL COLLECTION SYSTEM FOR TABLE TENNIS

(A) TECHNICAL FIELD OF THE INVENTION

The present invention is generally related to the sport of table tennis, and more particularly to a system for automatically collecting the halls on the ground of a table tennis court.

(B) DESCRIPTION OF THE PRIOR ART

Table tennis, also known as ping-pong, is a popular sport for all ages in which players hit a hollow ball back and forth across a net over a hard table.

During a game, if the ball drops on the ground, the players must bend or squat down to pick up the ball. The constant activity of picking up the dropped ball put significant burden on, and sometimes even injury to, the backs and knees of the players, especially for elder players. It is also quite often that the dropped ball rolls under the table, making the picking up even more difficult. It is not uncommon that more than one third of the time is spent on picking up balls during a game or practice.

Specifically during practice, a large number of balls are used and the dropped balls are spread around the court. Collecting the balls would consume a lot of time and effort. If the balls are left un-collected, the players may step on the balls, thereby damaging or tripping over the balls.

Currently, there is a ball collection system commercially available similar to a vacuum cleaner, which involves a base, an air guiding device, a flexible pipe, and a pressure adjusting device. Firstly, the flexible pipe is connected to a blowing end of the air guiding device and the balls on the ground are blown to a spot. Then, the flexible pipe is connected to a sucking end of the air guiding device and the balls gathered at the spot are sucked into a collection box of the base. The ball collection system still requires manual operation and the operator still has to bend or squat down.

SUMMARY OF THE INVENTION

As such, an automatic ball collection system for automatically collecting the balls spreading on the ground of a table tennis court so as to avoid the time and effort of the players in constant bending and picking up balls, and the possible injury resulted as such.

The ball collection system contains a blower sub-system and a collection device. The blower sub-system dives the balls on the ground towards the collection device, and the balls are then automatically collected by the collection device. The blower sub-system contains a first blowing device, a second blowing device, a third blowing device, and a fourth blowing device, each configured at a corner capable of producing air flow substantially along ground surface so as to push the balls to roll.

The collection device is configured inside an area surrounded by the first, second, third, and fourth blowing devices. The collection device contains a pipe, a fifth blowing device, and a basket. The pipe has a diameter larger than that of the balls P and has an air inlet positioned adjacent to the ground. The fifth blowing device has a fifth air outlet connected to an end of the pipe so that air is driven in the pipe. The basket is connected to the other end of the pipe for receiving the balls collected through the pipe.

The balls on the ground are first forced to roll towards the air inlet by the first, second, third, and fourth blowing devices. As the balls are in close proximity of the air inlet, they are then further drawn into the air inlet through the negative pressure created by the fifth blowing device. The balls are subsequently pushed along the pipe and finally received by the basket. As such, the players are free from the constant bending and picking up balls, and the possible injury resulted.

An optional control device could be configured to control the on/off and magnitude of air flow of the blowing devices at the corners and the fifth blowing device. The control device could be further electrically connected to a sensor to detect the location of the balls so as to achieve higher efficiency.

Each of the blowing devices at the corners could be installed on a ramp so that the balls would not roll into some dead space where the air flow from the corner blowing devices cannot reach.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which, a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, an automatic ball collection system according to an embodiment of the present invention contains a blower sub-system 10 and a collection device 20. The blower sub-system 10 drives the balls P on the ground towards the collection device 20, and the balls are then automatically collected by the collection device 20.

Figure 3:
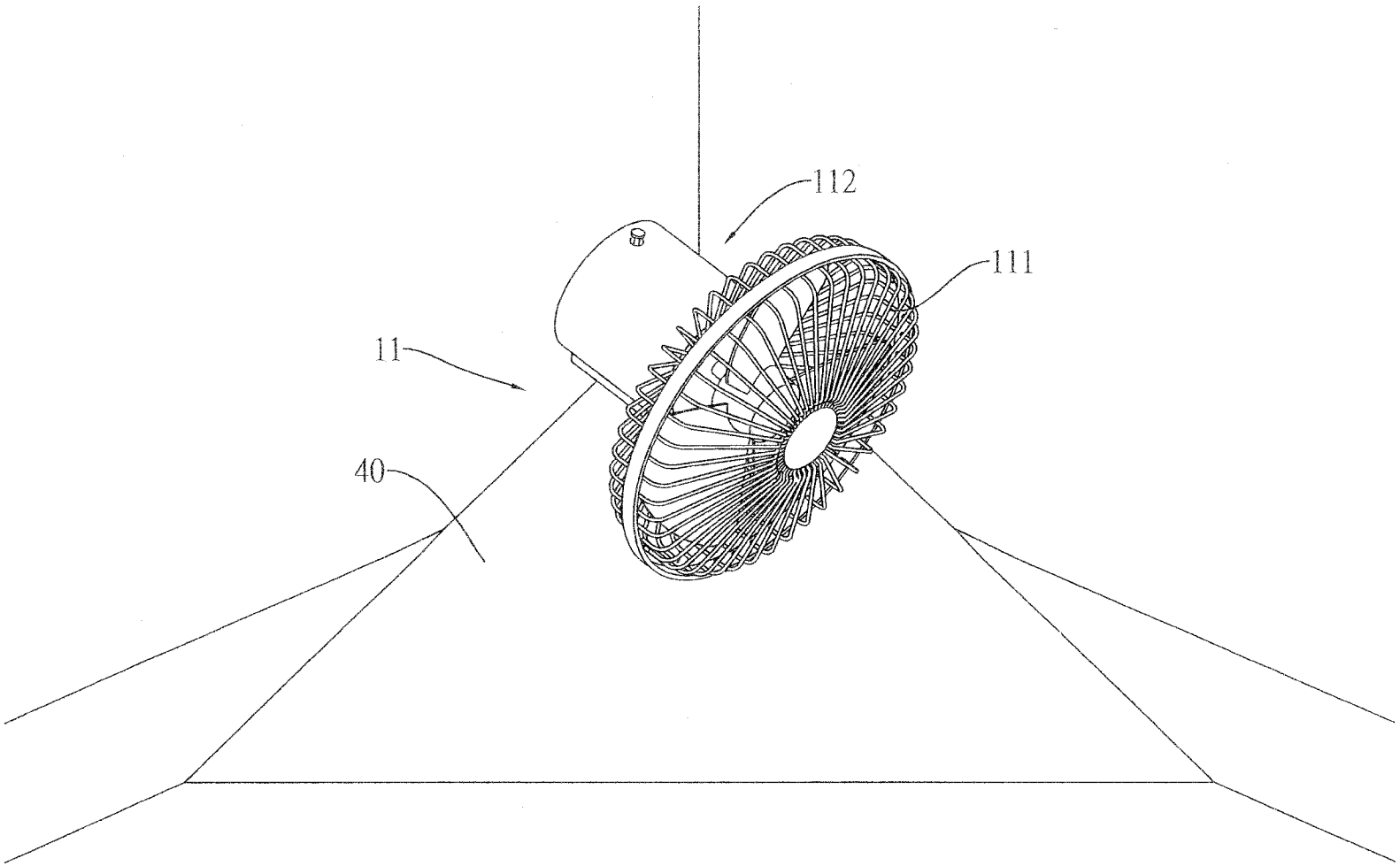
FIG. 3 is a perspective diagram showing a first blowing device of the automatic ball collection system of FIG. 1.

The blower sub-system 10 contains a first blowing device 11, a second blowing device 12, a third blowing device 13, and a fourth blowing device 14. The four blowing devices are for the generation and delivery of air flow. In the present embodiment, the four blowing devices are of the same device but this is not a requirement. As shown in FIG. 3, the first blowing device 11 has a first air outlet 111 and, similarly, the second, third, and fourth blowing devices 12, 13, and 14 have an air outlet, respectively (as the blowing devices are identical, the other air outlets are not numbered). The air flow produced by the first, second, third, and fourth blowing devices 11, 12, 13, and 14 are directed towards the ground through their respective air outlets.

Figure 1:
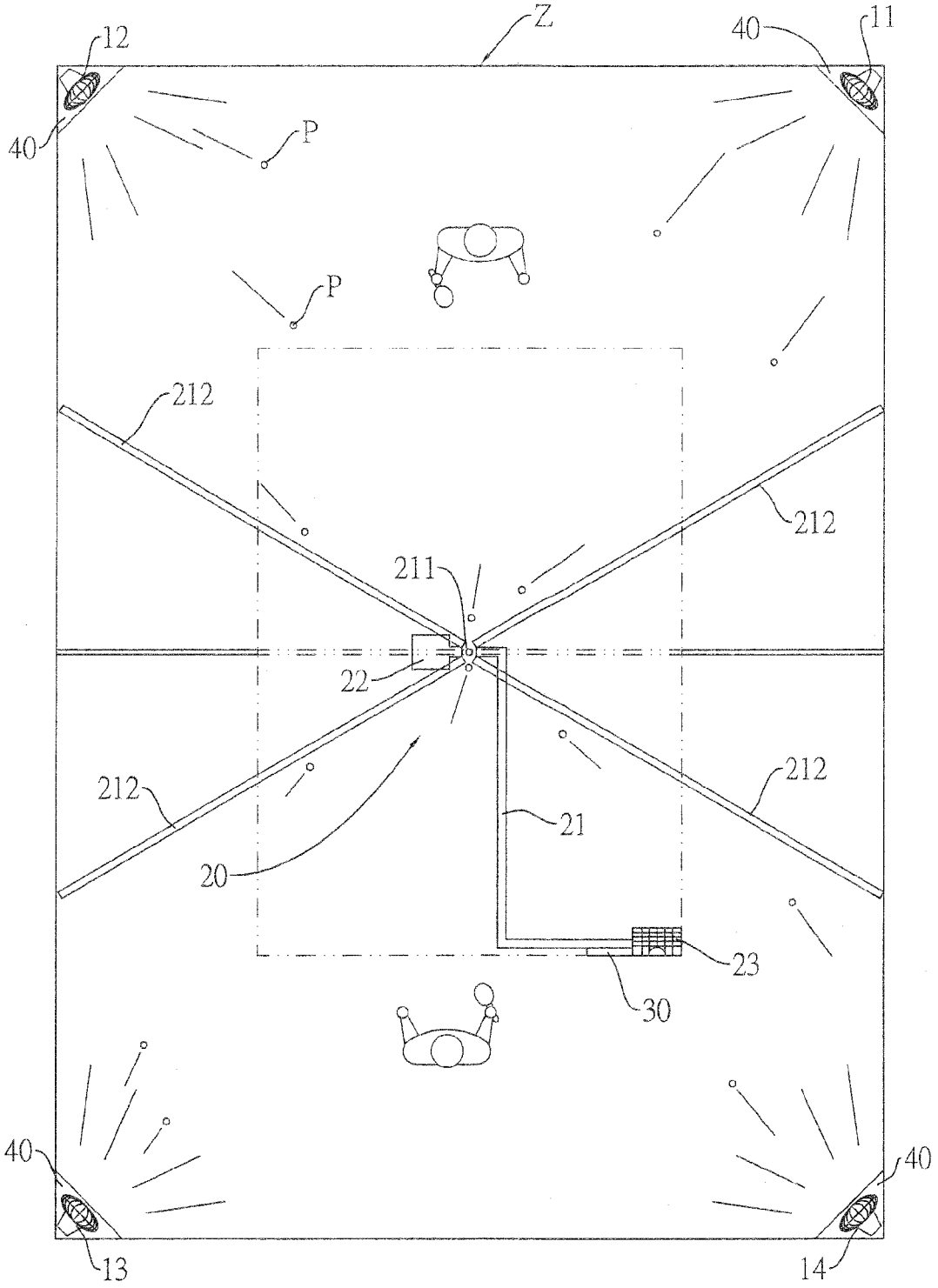
FIG. 1 is a schematic top-view diagram showing an automatic ball collection system according to an embodiment of the present invention.
Figure 2:
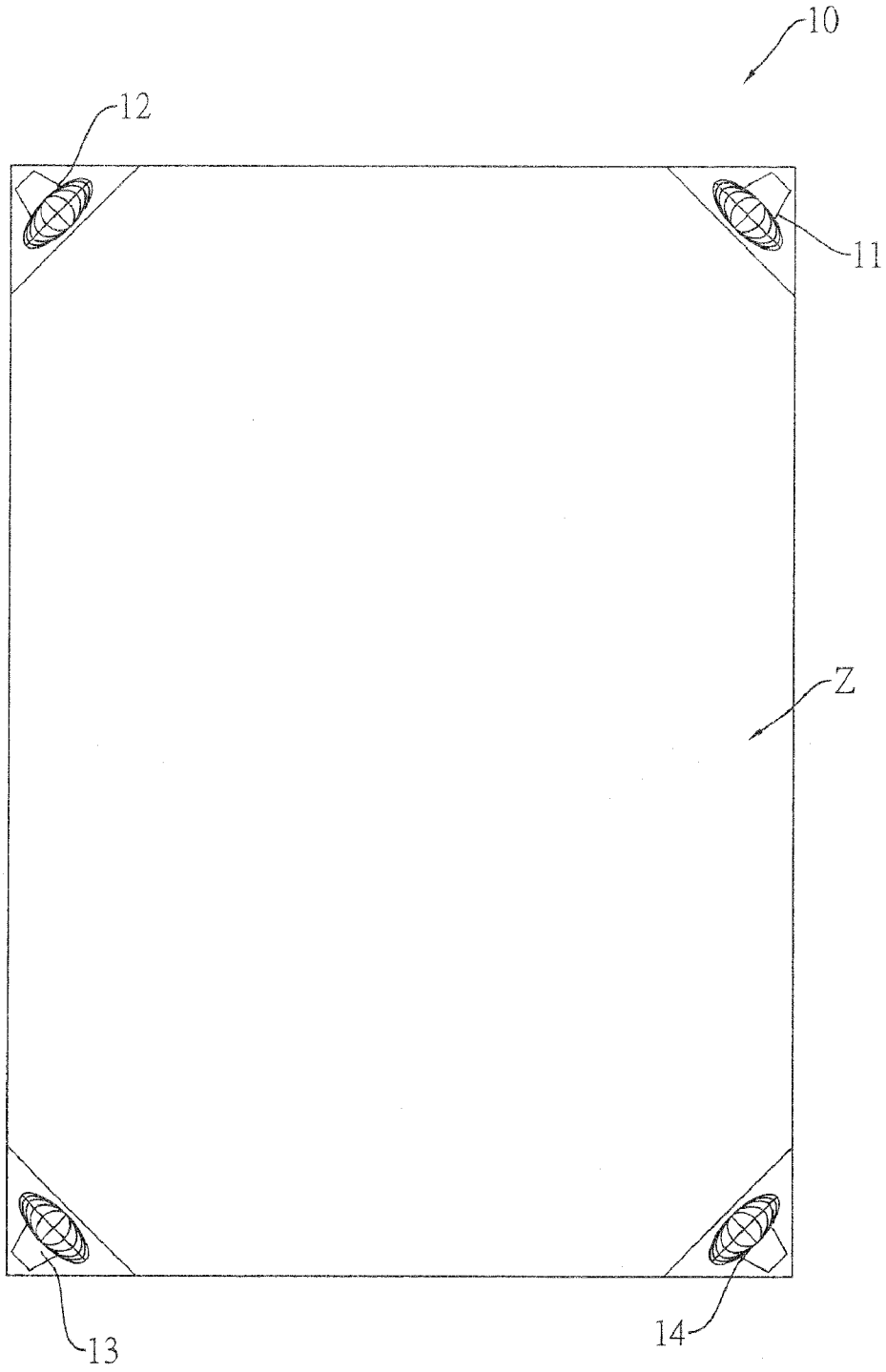
FIG. 2 is a top-view diagram showing a blower sub-system of the automatic ball collection system of FIG. 1.

As shown in FIGS. 1 to 3, the first, second, third, and fourth blowing devices 11, 12, 13, and 14 are positioned at an area Z's four corners, all having their outlets facing the area Z. The tennis table and other related apparatus are placed in the area Z. Again, using the first blowing device 11 as example, each of the blowing devices has a turning member 112, adjusting the air outlet 111's direction. As such, the air flow produced and delivered by the blowing devices 11, 12, 13, and 14 cover the entire area Z. A blowing device involving a turning member and an air outlet could be implemented in various ways such as an electric fan, and its details are omitted here.

Figure 4:
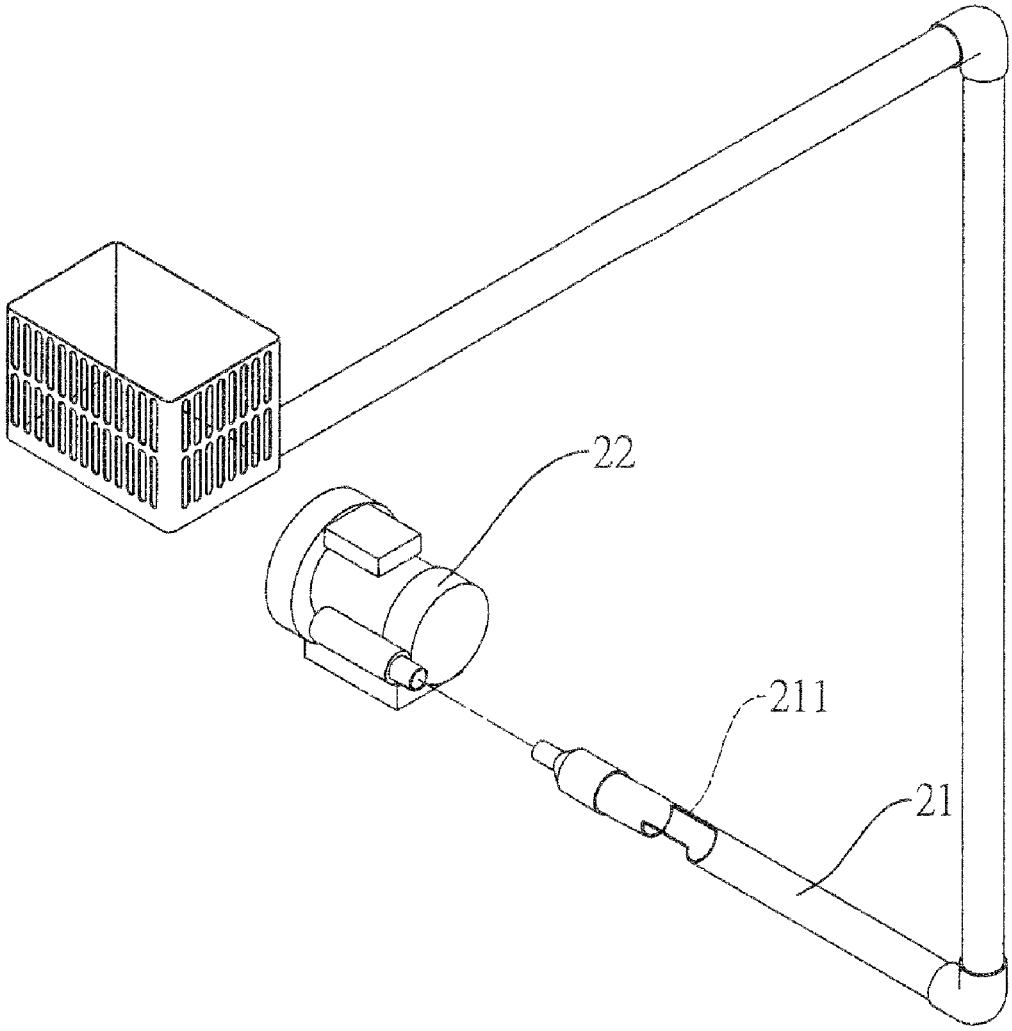
FIG. 4 is a perspective diagram showing a collection device of the automatic ball collection system of FIG. 1.
Figure 5:
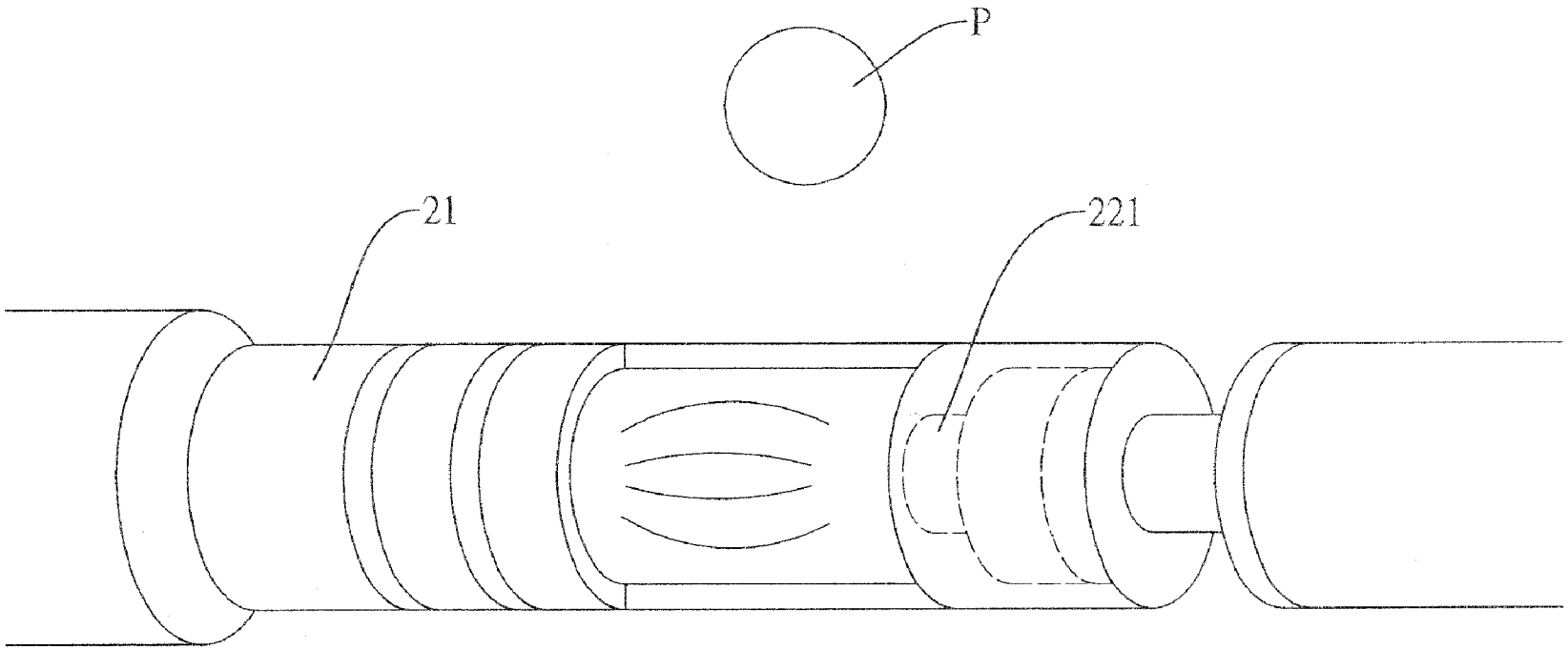
FIG. 5 is a perspective diagram showing an air inlet of the collection device of FIG. 4.

As shown in FIGS. 4 and 5, the collecting device 20 is placed inside the area Z and contains a pipe 21, a fifth blowing device 22, and a basket 23. The pipe 21 has a diameter larger than that of the balls P and has an air inlet 211 positioned adjacent to the ground. The air inlet 211 has an aperture larger than the balls P's diameter. The fifth blowing device 22 has a fifth air outlet 221 connected to an end of the pipe 21 so that air is driven in the pipe 21. The basket 23 is connected to the other end of the pipe 21 for receiving the balls P collected through the pipe 21.

As shown in FIG. 1, the way the present system collecting balls P on the ground is first to force the balls P to roll towards the air inlet 211 by the blowing devices 11, 12, 13, and 14. As the balls P are in close proximity of the air inlet 211, they are then further drawn into the pipe 21 through the suction created by the fifth blowing device 22. The balls P are subsequently pushed along the pipe 21 and finally received by the basket 23. More specifically, the high-pressure air stream created by the fifth blowing device 22 not only creates the negative pressure to suck the neighboring balls P into the air inlet 211, but also provides the force to roll the balls P in the pipe 21 into the basket 23.

The basket 23 could be positioned an appropriate place depending on the actual environment and user requirement. In the present embodiment, it is positioned beneath and adjacent to an end of the table so that a player could easily pick up a ball collected in the basket 23.

Each of the blowing devices 11, 12, 13, and 14 could be any device capable of producing air flow such as a blower, a cross-flow fan, or an electrical fan.

Figure 6:
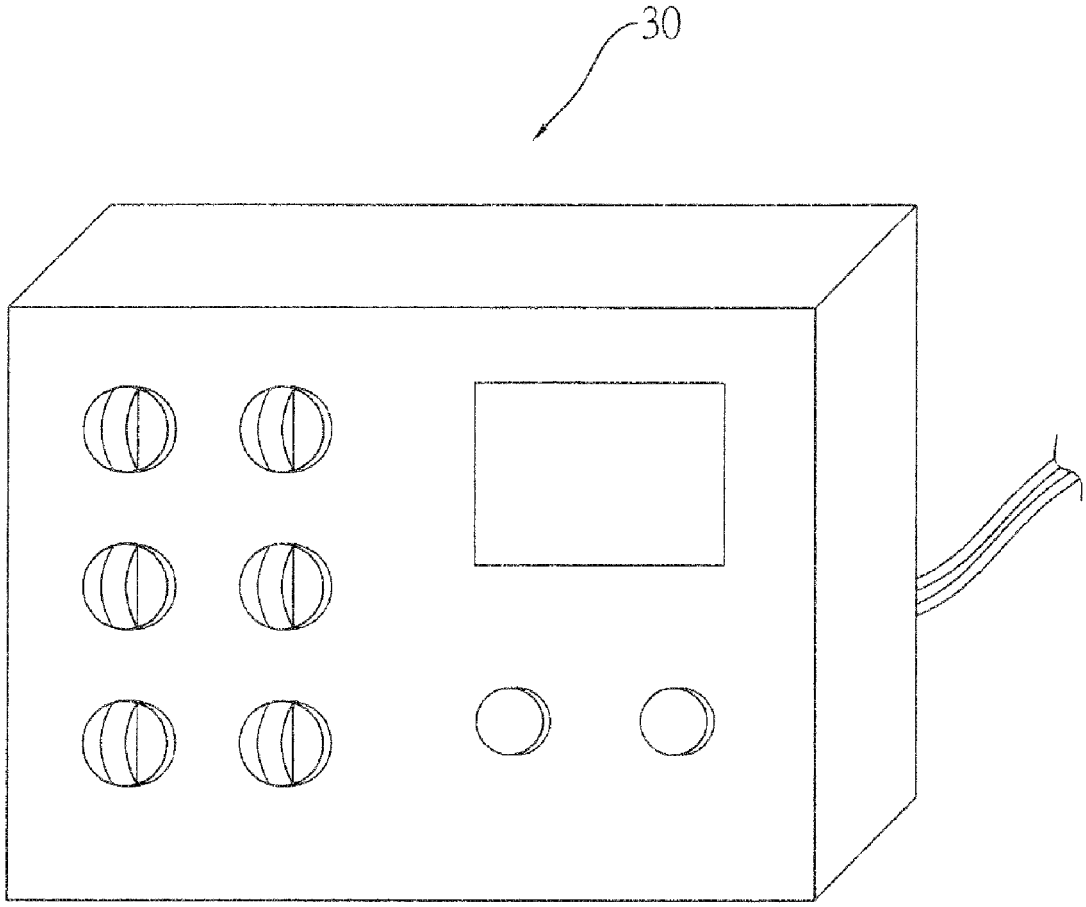
FIG. 6 is a perspective diagram showing an optional control device for the automatic ball collection system of FIG. 1.

As shown in FIG. 6, an optional control device 30 could be electrically connected to the blowing devices 11, 12, 13, 14, and 15, and related control software is installed and executed by the control device 30. The control device 30 therefore could, for example, decide a sequence of turning on the blowing devices 11, 12, 13, 14, and 15, or provide a timing function. The control device 30 could be further electrically connected to a sensor at an appropriate place. The sensor could detect the location of the balls P and transmit the relevant information to the control device 30 which in turn could decide whether to turn on the fifth blowing device 22, or simply to turn on one or more near-by blowing devices, so as to achieve higher efficiency. The sensor should be well understood for people in the related art and therefore it is not shown in the accompanied drawings. There is also no special requirement to the sensor and any sensor capable of detecting object location could be used.

As shown in FIG. 3, each of the blowing devices 11, 12, 13, and 14 could be installed on a ramp 40 so that the balls P would not roll into some dead space where the air flow from the blowing devices 11, 12, 13, and 14 cannot reach.

Figure 7:
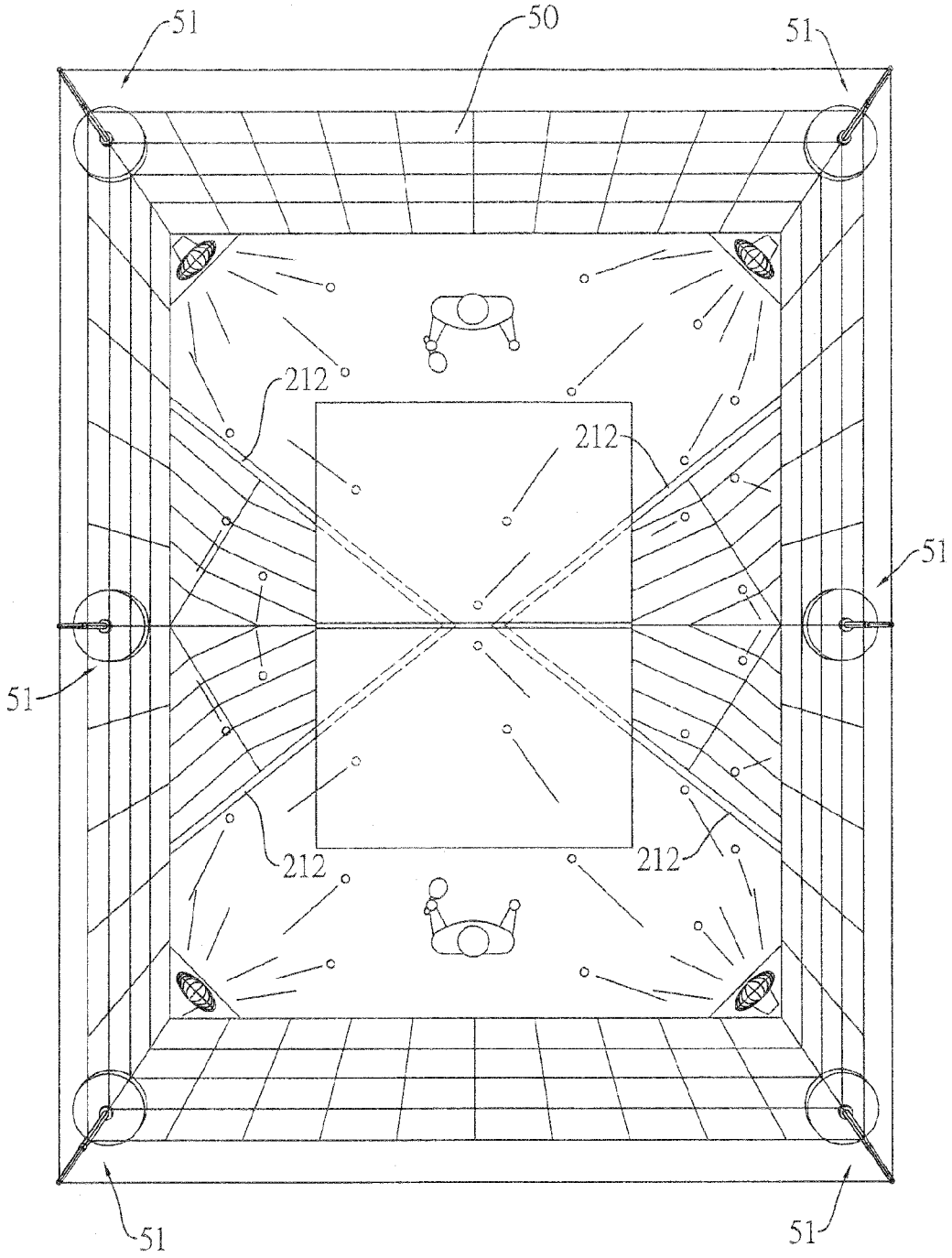
FIG. 7 is a top-view diagram showing an optional net is configured with the automatic ball collection system of FIG. 1.
Figure 8:
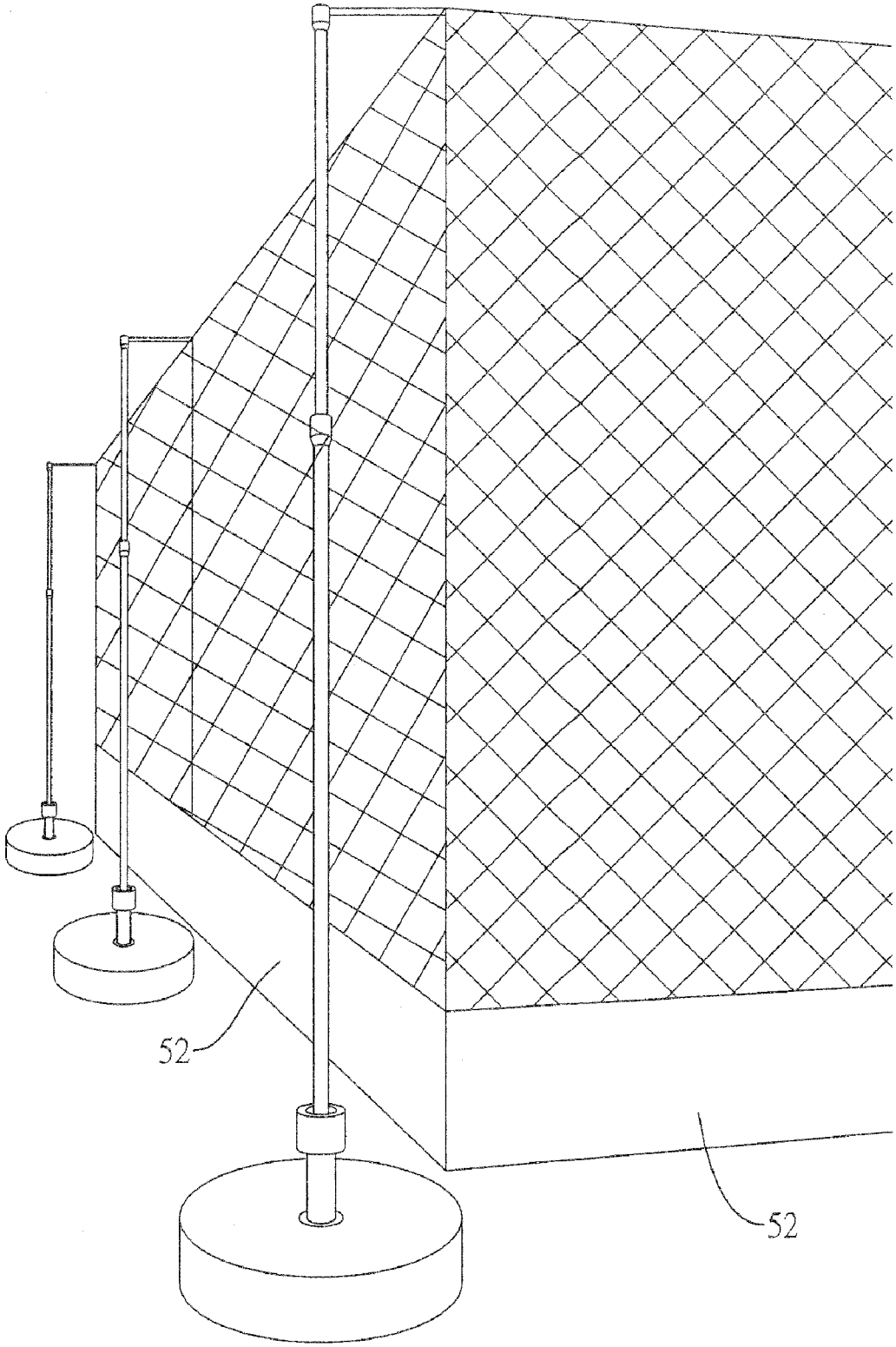
FIG. 8 is a perspective diagram showing the net of FIG. 7.

As further shown in FIGS. 7 and 8, a net 50 could be optionally raised by a number of moveable poles 51 surrounding the blowing devices 11, 12, 13, and 14 so as to avoid the balls P from flying out of the area Z. Each pole 51 could have a water-filled base. When put to use, the bases are filled with water so as to provide solid foundations for the poles 51. After use, the bases could be emptied to facilitate transportation. Furthermore, a band 52 could be configured along the bottom rim of the net 50. With the band 52, the stability of the net 50 is enhanced and the balls P will only roll smoothly along the band 52, instead of sticking in the meshes of the net 50.

Additionally, two slant guiding plates 212 could be configured at each of the two sides of the air inlet 211 facing two opposing sides of the area Z so as to facilitate the collection the balls P into the air inlet 211.

Figure 9:
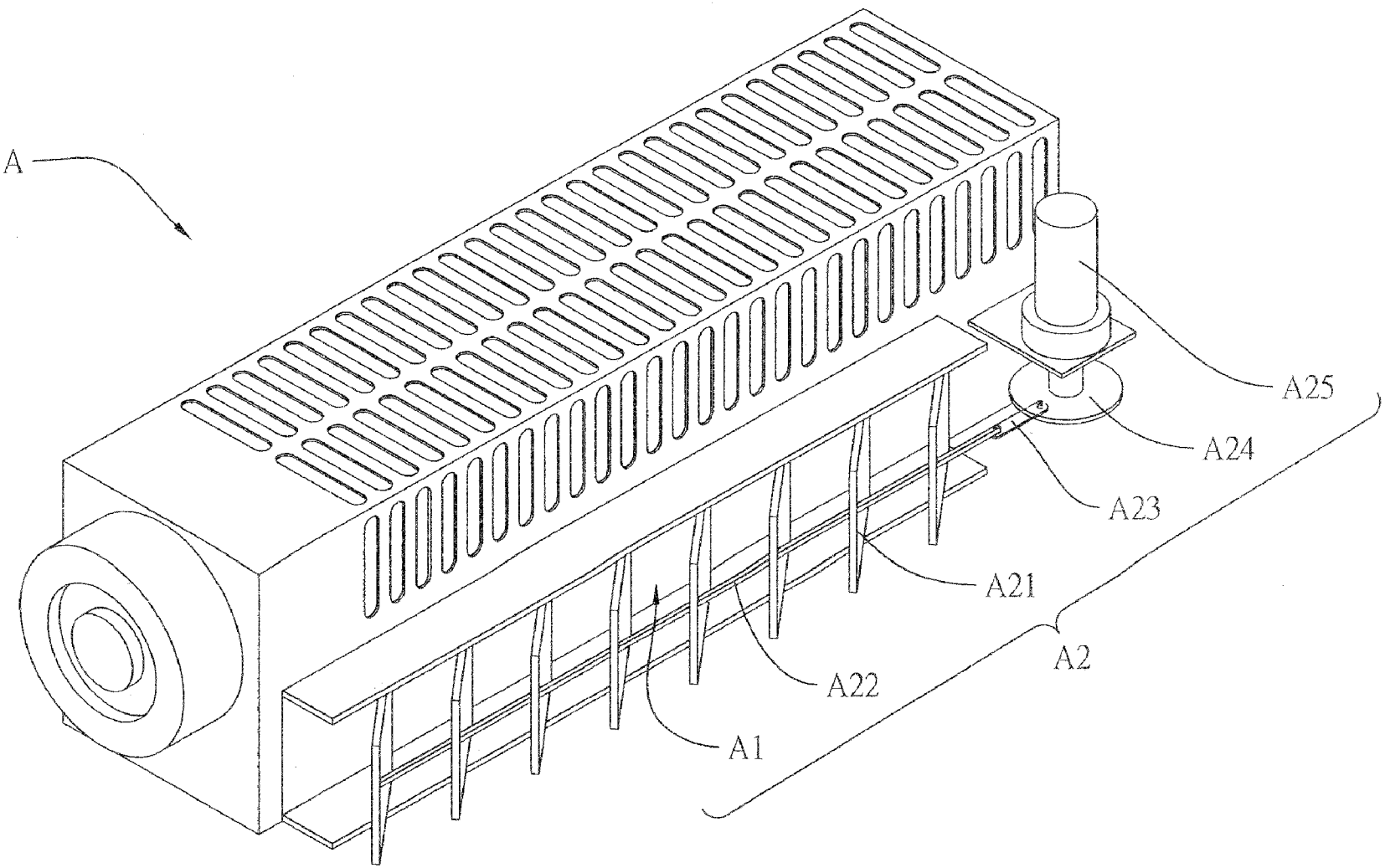
FIG. 9 is a perspective diagram showing an embodiment of the blowing devices as a cross-flow fan.
Figure 10:
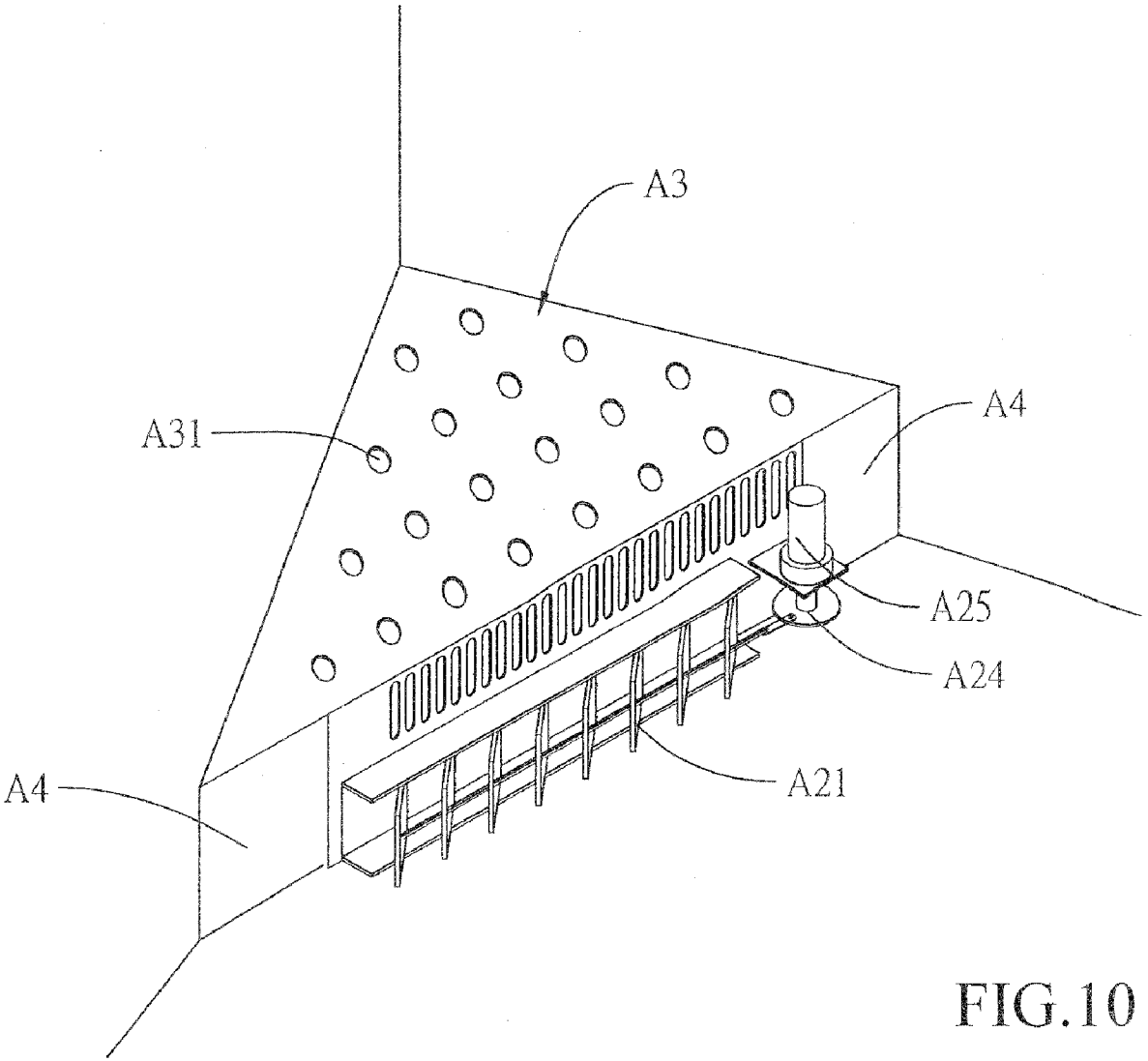
FIG. 10 is a perspective diagram showing a cross-flow fan of FIG. 9 integrated with a top slant plate and two blocking plates.
Figure 11:
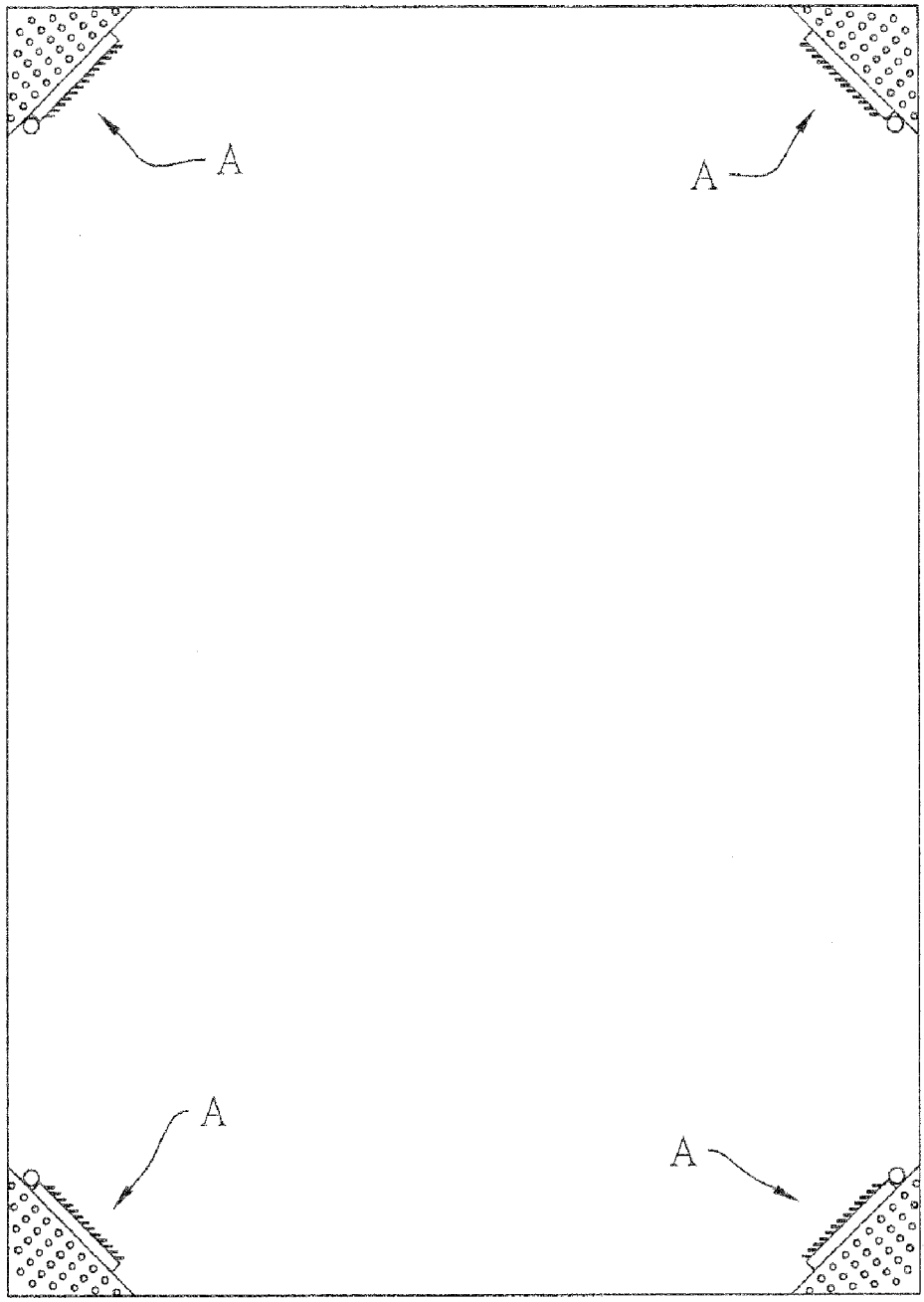
FIG. 11 is a top-view diagram showing a blower sub-system of the automatic ball collection system of FIG. 1 using the cross-flow fan of FIG. 10.

FIGS. 9 to 11 illustrate an embodiment of the blowing devices where each of the blowing devices 11, 12, 13, and 14 is implemented as a cross-flow fan A. Each cross-flow fan A contains an air outlet A1 and a guiding member A2 is configured in front of the air outlet A1 so as to direct the air flow towards a specific direction. The guiding member A2 contains a number of fans A21, a connecting rod A22, a linking rod A23, a disc A24, and a driving element A25. Each of the fans A12 is pin-joined to the air outlet A1 and is threaded through by the connecting rod A22. An end of the connecting rod A22 is pin-joined to the linking rod A23 which in turn is pin-joined to the disc A24. The disc A24 is driven by the driving element A25. When the disc A24 spins for an angle, the linking rod A23 is engaged and therefore the connecting rod A22 is put into a lateral back-and-forth movement. The fans A21 are as such swung laterally relative to the air outlet A1.

As shown in FIG. 10, a plate A3 is configured slantwise above the cross-flow fan A so that no balls P would accumulate on the cross-flow fan A. A number of vent holes A31 could be configured on the plate A3 to facilitate air circulation. Furthermore, two blocking plates A4 are configured at the two lateral sides of the cross-flow fan A so as to prevent the balls P from entering some dead space between the cross-flow fan A and the walls.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An automatic ball collection system for collecting balls of table tennis comprising a blower sub-subsystem and a collection device;

said blower sub-system comprising:

a first blowing device having a first air outlet and said first blowing device producing an air flow directed toward the pound through said first air outlet;

a second blowing device having a second air outlet and said second blowing device producing an air flow directed toward the ground through said second air outlet;

a third blowing device having a third air outlet and said third blowing device producing an air flow directed toward the ground through said third air outlet; and a fourth blowing device having a fourth air outlet and said fourth blowing device producing an air flow directed toward the ground through said fourth air outlet;

where said first, second, third, and fourth blowing devices are positioned at an area's four corners, all having said first, second, third, and fourth air outlets facing said area; and said collection device inside said area comprising:

a pipe having a diameter larger than that of a ball for table tennis, an air inlet positioned adjacent to the ground, said air inlet having an aperture larger than the diameter of a ball for table tennis;

a fifth blowing device having a fifth air outlet connected to an end of said pipe so that air flow from said fifth blowing device is directed into said pipe; and a basket connected to the other end of said pipe.

2. The automatic ball collection system according to claim 1, further comprising a control device electrically connected to said first, second, third, fourth, and fifth blowing devices.

3. The automatic ball collection system according to claim 2, further comprising a sensor electrically connected to said control device.

4. The automatic ball collection system according to claim 3, wherein each of said first, second, third, and fourth blowing devices is configured on a ramp.

5. The automatic ball collection system according to claim 4, further comprising two slant guiding plates configured at each of the two sides of said air inlet of said collection device facing two opposing sides of said area.

6. The automatic ball collection system according to claim 5, further comprising a net and a plurality of moveable poles; wherein said net is raised by said poles to surround said first, second, third, and fourth blowing devices.

7. The automatic ball collection system according to claim 6, wherein a band is configured along a bottom rim of said net.

8. The automatic ball collection system according to claim 7, wherein a guiding member is configured in front of each of said first, second, third, and fourth air outlets.

9. The automatic ball collection system according to claim 8, wherein each of said first, second, third, and fourth blowing devices is a cross-flow fan.

10. The automatic ball collection system according to claim 9, wherein said guiding member comprises a plurality of fans pin-joined to each of said first, second, third, and fourth air outlets, a connecting rod threading through said fans, a linking rod having an end pin-joined to said connecting rod, a disc pin-joined to the other end of said linking rod, and a driving element driving said disc; wherein, said disc spins for an angle, said linking rod is engaged and therefore said connecting rod is put into a lateral back-and-forth movement; said fans are as such swung laterally relative to said air outlet.

* * * * *